United States Patent [19]

Bullock

[11] Patent Number: 4,699,287

[45] Date of Patent: Oct. 13, 1987

[54] CONTAINER CAP HAVING ROUNDED RETAINER BEAD SECTIONS

[75] Inventor: Joseph J. Bullock, Atherton, Calif.

[73] Assignee: Bankers Trust Co., New York, N.Y.

[21] Appl. No.: 892,317

[22] Filed: Aug. 1, 1986

Related U.S. Application Data

[63] Continuation-in-part of Ser. No. 652,525, Sep. 20, 1984, which is a continuation-in-part of Ser. No. 517,666, Jul. 27, 1983, Pat. No. 4,484,687.

[51] Int. Cl.[4] ..... B65D 41/48

[52] U.S. Cl. ..... 215/256; 215/321

[58] Field of Search ..... 215/256, 321

[56] References Cited

U.S. PATENT DOCUMENTS 4,166,552 9/1979 Faulstich ..... 215/256

4,484,687 11/1984 Bullock ..... 215/256

*Primary Examiner*—Donald F. Norton

*Attorney, Agent, or Firm*—Julian Caplan

[57] ABSTRACT

A container having a neck formed with external shoulders and grooves below the shoulders is closed by a plastic cap having a depending skirt formed with interrupted internal beads which lock under the neck shoulders and are received in the neck grooves. A circumferential scoreline is formed in the skirt above the lower bead and is connected to a second scoreline which extends down to the lower edge of the skirt. Adjoining the terminus of the second scoreline is a tab which may be gripped and pulled to tear the skirt upward along the second scoreline and then circumferentially around the first scoreline to remove the lower part of the skirt and make it possible to remove the remaining portion of the cap.

The improvement consists in making the bead sections in various truncated conical shapes distributed in various patterns. These shapes facilitate application of the cap to the neck without splitting the former or crushing the latter. The conical shapes may be circular or elliptical in cross-section and may be aligned or staggered.

21 Claims, 17 Drawing Figures

CONTAINER CAP HAVING ROUNDED RETAINER BEAD SECTIONS

BACKGROUND OF THE INVENTION

This invention is a continuation-in-part of pending application Ser. No. 652,525, filed Sept. 20, 1984 which was a continuation-in-part of application Ser. No. 517,666, filed July 27, 1983, now U.S. Pat. No. 4,484,687, issued Nov. 27, 1984.

More particularly, the invention is an improvement on U.S. Pat. No. 4,166,552 and other prior patents of the assignee of this application.

FIELD OF THE INVENTION

The present invention relates to plastic caps which snap onto the necks of thin-walled plastic containers and are characterized by the fact that they are tamper-resistant and tamper-evident. In order to remove the cap from the neck, it is necessary for the consumer to tear a portion of the skirt off the cap giving evidence that there has been tampering with the container. Without tearing off the bottom of the skirt, the cap cannot be removed without great effort and the effort damages the cap so that there is further evidence of tampering. The portion of the cap above that torn off comprises a reclosure cap which may be used repeatedly until the contents of the container are dispensed. The container neck is of a structure which is complementary to the cap, so that the combination of cap and container neck is liquid-tight and tamper-resistant.

DESCRIPTION OF THE PRIOR ART

Cap and neck constructions of this general type are shown in U.S. Pat. No. 3,338,446 and 4,202,455 as well as 4,484,687, and 4,166,552. In all of these cap constructions, complementary beads on the interior of the outer skirt of the cap snap into grooves on the container neck. In some of these patents, the beads are interrupted and the present invention comprises improvements on such interrupted beads. A circumferential scoreline is located in the outer skirt intermediate the beads and a second scoreline extends down from the circumferential scoreline to the bottom edge of the skirt of the cap. A tear tab depending from the bottom of the skirt adjacent the second scoreline may be gripped and torn upward, causing the cap to tear on the second scoreline and thence around the circumferential scoreline. In order to remove the upper portion of the cap from its reclosure mold, and also to increase the area available for information such as the name of the seller and a listing of the ingredients of the contents of the container, caps have heretofore been provided with peripheral flanges.

A feature of the present invention relates to the shapes of the upper and lower beads on the interior of the cap skirt. Such beads are made interrupted and a particular the cross-sectional feature of the invention is the fact that the cross-sectional shape of the interrupted bead sections may be circular or elliptical. Further features of the invention are the fact that the bead sections may be distributed in various patterns. Thus, the upper bead sections may be staggered relative to the lower beads or they may be aligned.

In some of the prior art heretofore mentioned, the caps have been provided with an inner skirt or plug which fits in and seals against the inside of the neck of the container. In other constructions, a foil seal disc is applied to the lip of the container neck. The present invention may be used with either of these structures.

SUMMARY OF THE INVENTION

The present invention augments the tamper-evident and tamper-resistant characteristics of the prior art cap and neck constructions. As hereinafter set forth in detail among the features of the invention which accomplish this objective are the following:

A foil seal may be applied to the lip of the neck of the container and secured thereto by inductive heating or other means. As set forth in U.S. Pat. No. 4,484,687, such a seal may be initially installed in the inside of the cap and held therein prior to application of the cap to the neck of the container by the internal beads of the skirt of the cap. The present invention discloses in part improved internal bead constructions which retain the seal in place effectively so that the possibility of a container not being sealed with foil is reduced.

Various flanges have been used on reclosure caps to permit the user to pry off the reclosure cap. However, it is important that the flange not be capable of use to pry the entire cap off the neck prior to tearing of the cap skirt. One prior alternative has been to make the flange flexible, as shown in U.S. Pat. No. 4,166,552. Such a means may be used in accordance with the present invention. Additional features of the invention are the provision that the underside of the flange is slanted downwardly-inwardly at an angle of about 45°. The slanted portion may terminate at the upper edge of the flange or the outer edge of the slanted flange may be truncated in a thin vertical surface.

Other objects of the present invention will become apparent upon reading the following specification and referring to the accompanying drawing in which similar characters of reference represent corresponding parts in each of the several views.

Figure 14:
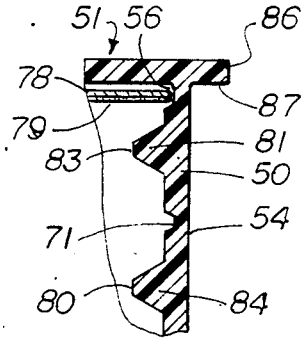
Figure 15:
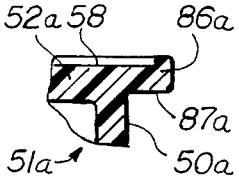
Figure 16:
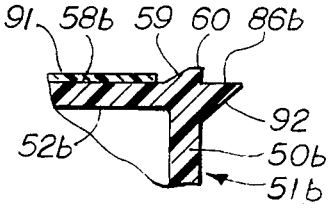
Figure 3:
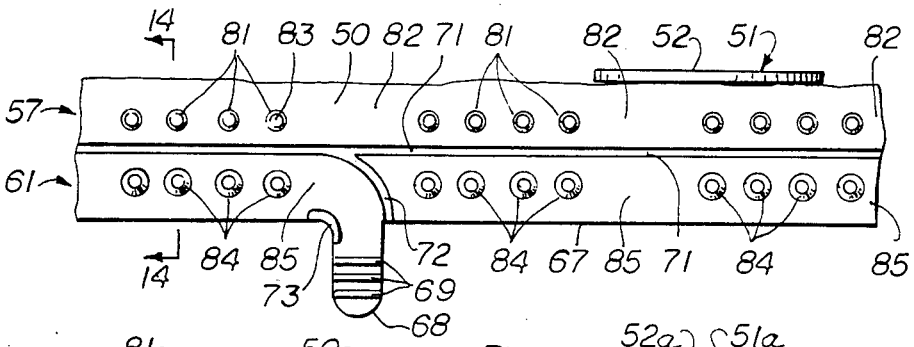

FIGS. 3 through 13 inclusive are schematic views showing the interior of the outer cap skirt developed in a flat plane and illustrating different interrupted upper and lower bead section shapes and distribution patterns;

FIG. 14 is a fragmentary sectional view taken substantially along the line 14—14 of FIG. 3 and also showing a foil liner for the cap;

FIGS. 15 and 16 are fragmentary sectional views through a cap showing modified flange structures and depressions in the cap top disc for a label or other identification.

Figure 17:
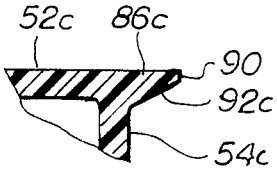

FIG. 17 is a view similar to FIG. 14 of a modified flange.

DESCRIPTION OF PREFERRED EMBODIMENTS

Figure 1:
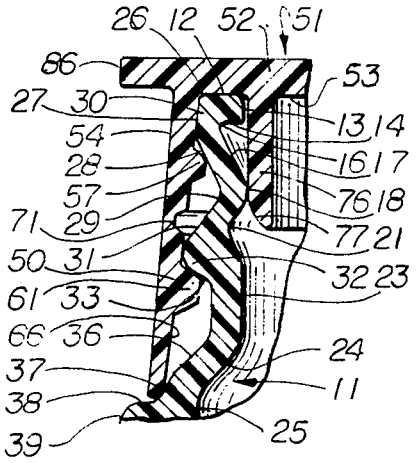
FIG. 1 is a fragmentary vertical sectional view of a portion of a container neck and a cap applied thereto.
Figure 2:
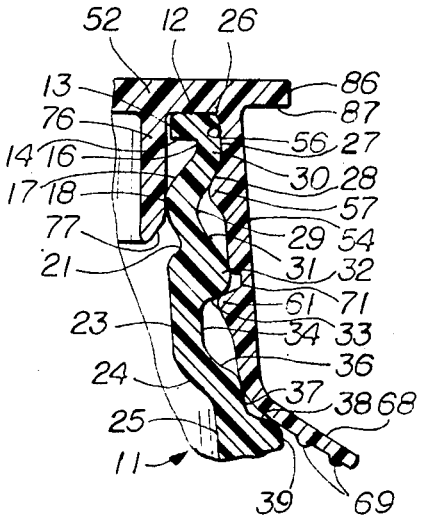
FIG. 2 is view similar to FIG. 1 showing the cap and neck rotated sufficiently to disclose the tear tab used to remove the lower portion of the skirt.

Directing attention to FIGS. 1 and 2, one form of container neck 11 which may be used with caps of the present invention are illustrated. It will be understood that the shape of the neck is subject to considerable variation, although it is important that the neck configuration be such that the cap 51 will lock thereon and be tamper-resistant, so that efforts to tamper with the contents of the container will be evident. Further, it is important that the cap and neck seal in a liquid-tight manner.

Neck 11 has a thin inward extending horizontal top flange 12 which terminates in a substantially vertical inner edge 13. Below edge 13 of flange 12 is a substantially horizontally outwardly extending surface 14 which terminates in a top internal groove 16. Below groove 16, the inside wall of the neck 11 slants downwardly-outwardly in a surface 17 terminating in a sealing surface 18. Below surface 18 is a second internal groove 21 and below the groove 21 is vertical wall 23 which terminates in a outwardly-downwardly slanted wall 24 which, in turn, terminates in an internal vertical wall 25. The internal structure of the neck 11 is subject to considerable variation.

Directing attention next to the exterior of the neck 11, the top corner 26 where flange 12 originates is slightly rounded and merges into top external vertical wall 27, There is a slightly inwardly directed shoulder 28 at the lower edge of wall 27 which continues inward and merges into groove 29 which is of lesser diameter than wall 27. The portion of the exterior of the neck above groove 29 comprises the upper or first locking bead 30. Below groove 29 is a downwardly-outwardly slanted wall 31 which comprises the top surface of second external locking bead 32. The lower edges of bead 32 comprise shoulder 33. Below shoulder 33 is a second external vertical wall 34 which is of lesser diameter than groove 29. Below wall 34 is an outward slanted wall 36 which terminates in third external elongated vertical wall 37 which has a diameter greater than wall 27. Below wall 37 is a top shoulder 38 on bumper ring 39. The structure of the exterior of neck 11 is subject to considerable variation.

Directing attention now to cap 51, again the structure of the cap is subject to variation and in its general principles resembles the commercially highly successful cap of assignee. In the preferred embodiment shown in FIG. 1, cap 51 has a preferably flat top disc 52 on which a label or printed matter may be applied. The bottom 53 of disc 52 is also preferably flat. Depending from disc 52 is a cap skirt 50 having an external wall 54. In the preferred embodiment of the wall 54, the surface is smooth and substantially vertical. The inside surface of the cap skirt 50 has a top internal vertical wall 56. Top locking bead means 57 are provided on the interior of the skirt 50 below the wall 56 positioned to lock under the upper cap bead 30 in the assembled condition of the cap and the neck. Upper bead means 57 are described in several modifications.

Second or lower bead means 61 may be provided. Lower bead means 61 are described in several modifications.

Below the bead sections 61 is a third vertical wall 66 which extends down to the bottom edge 67 of the skirt 50. At one location along the bottom edge 67 there is a depending tear tab 68 which may have gripper ridges 69 on its interior surface. Spaced between lower bead means 61 and upper bead means 58 is an internal scoreline 81. Extending upward from the bottom edge 67 of the cap 51 in immediate proximity to the tear tab 68 is a curved or slanted scoreline 82 which merges with the scoreline 81. The scoreline 82 curves upwardly and to the right from the left side of the tab 68. However, the line 82 might also curve upwardly and to the left of the right edge of the tab 68. A thickening 83 of the wall 54 adjacent line 82 prevents tearing off the tab 68, particularly if the user pulls the tab in the wrong direction.

Further directing attention to FIG. 1, depending from the underside of top disc 52 is an inner skirt or plug 76. The outer bottom edge thereof is slanted to assist in seating the cap on the neck. The exterior of the inner skirt 76 may seal with the outer edge 13 and/or the sealing surface 18 of the interior of the neck 11.

In the form of the invention shown in FIG. 14 prior to the cap 51 being applied to the neck 11, a foil sealing disc 78 of a commercially available type is applied to the underside 53 of the top cap disc 52. The bead means 57 assist in keeping the disc 78 in place prior to the cap being installed. When the cap is installed, the disc 78 seats on the flange 12. Adhesive 79 on the underside of disc 78 is caused to adhere to the flange 12 by induction heating or other means. If an attempt is made to tamper with the contents of the container, such tampering can usually be detected by examination of the condition of the disc 78. Disc 78 also improves the leakproof characteristics of the cap.

Figure 4:
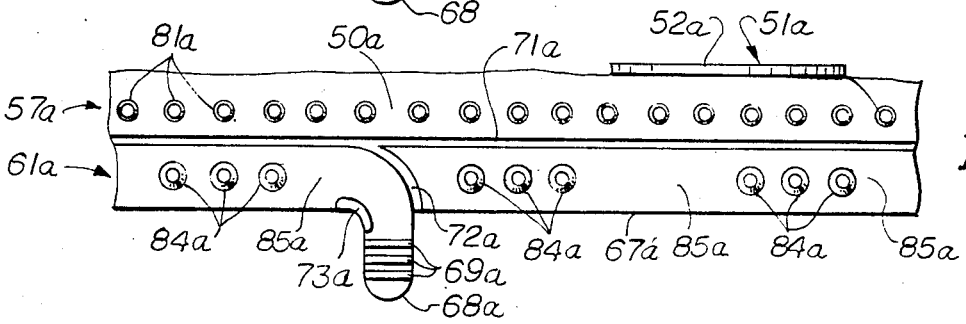

As shown in FIG. 1, a horizontal peripheral flange 86 projects out from the disc 52 at the upper end of the wall 4. In the modification shown in FIG. 16 the underside 87 of flange **86*b* slants upwardly-outwardly at an angle of about 45°. Thus, it is difficult for one to pry the cap off the neck 11 while the skirt 50 is intact. In FIG. 17 is shown a thin vertical edge 90 at the outer edge of slanted surface 87*b*. An alternate structure is shown in FIG. 4 where the flange 88 is rectangular in cross-section and there is a sharp corner 89 where the underside of the flange 88 intersects the wall 54. If an attempt is made to pry upward on the flange 88 while the skirt is intact, because of the sharp corner 89, the flange tears approximately along the line 90**. This prevents removing the cap, but also indicates that an attempt has been made to tamper with the contents.

Directing attention now to FIG. 15, it will be seen that a depression 58 may be formed in the top disc 52 to receive a label which may bear the named and trademark of the manufacturer of the contents of the container and appropriate description of the ingredients. In the form of the invention shown in FIG. 16, an outward upward slanted surface 59 is formed on the outer edge of the depression 58b to provide a stacking ring 60 whereby one cap may be stacked on top of another, a feature which is particularly desirable in large diameter caps which are subject to warping after molding.

In other respects, the modifications of FIGS. 15–17 resemble those of the preceding modifications and the same reference numerals followed by the subscripts a,b and c respectively, are employed.

FIG. 3, as has previously been stated, is a development in a plane of the inside of the outer skirt of cap 51. In this particular modification, there are three groups of truncated conical upper bead sections 81 above scoreline 71, there being four such bead sections in each group. The groups are separated by gaps 82. Referring to FIG. 14, the outer end 83 of each section 81 is flat. Below scoreline are conical lower bead sections 84 having flat ends 80 arranged in groups of four and separated by gaps 85. This construction facilitates stretching of the skirt 50 when the cap 51 is forced down over the neck 11. The conical shapes of the sections 81, 84 snap over the cap neck beads 30 and 32 with ease and, further, the skirt between the bead sections stretches more easily than if the beads were continuous. Hence, the likelihood of caps splitting or necks being crushed is reduced.

Figure 6:
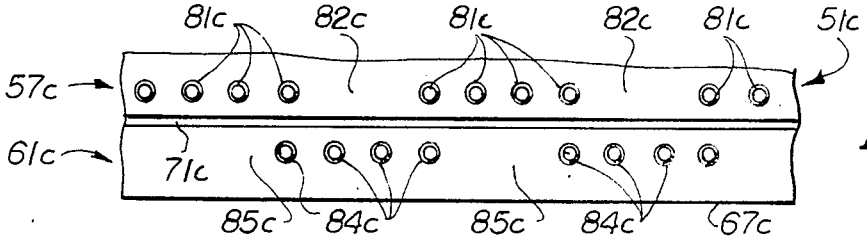

The number and arrangement of the bead sections 81, 84 is subject to variation. As s,hown in FIG. 4, the upper bead sections 81*a* are equally spaced continuously around the interior of the skirt. The lower bead sections 84*a* are arranged in groups of three separated by gaps 85*a*. As shown in FIG. 6, the bead sections are staggered. Thus, there are groups of upper bead sections 81*c* separated by gaps 82*c* and there are lower bead sections 84*c* separated by gaps 85*c*. The gaps 85*c* are substantially below the groups of upper bead sections 81*c* and the lower bead sections 84*c* are substantially aligned with the gaps 82*c*. However, as illustrated in FIG. 6, the outermost bead sections 81*c* may be aligned with the outermost bead sections 84*c*, and the upper and lower groups of bead sections are staggered. Further, it will be noted that the bead sections 84*c* are substantially the same diameter as the sections 81*c*, whereas in FIGS. 3 and 4 the sections 84 or 84*a* are larger than the sections 81 or 81*a*.

Figure 7:
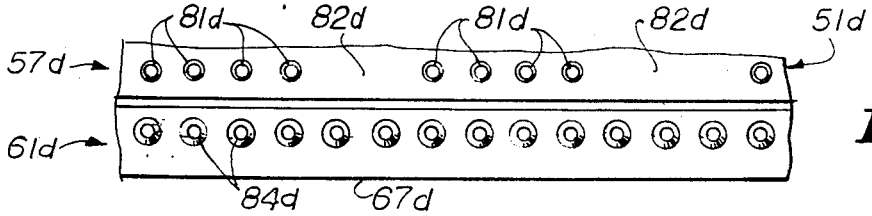

In the structure shown in FIG. 7, the upper bead sections 81*d* are arranged in groups of four separated by gaps 82*d* while the larger diameter lower bead sections 84*d* are spaced substantially equally around the periphery of the interior of the outer skirt of the cap. In the latter respect, the distribution of FIG. 7 is the reverse of the distribution of FIG. 4.

Figure 8:
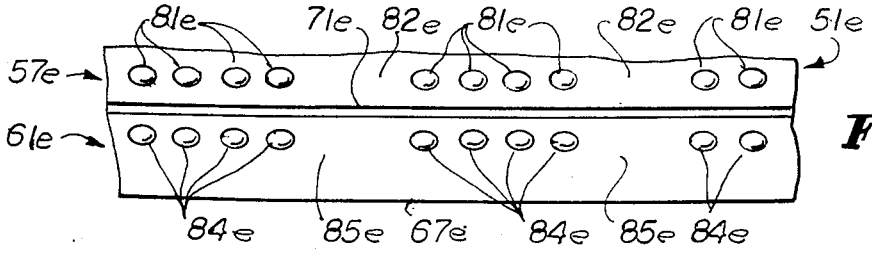
Figure 9:
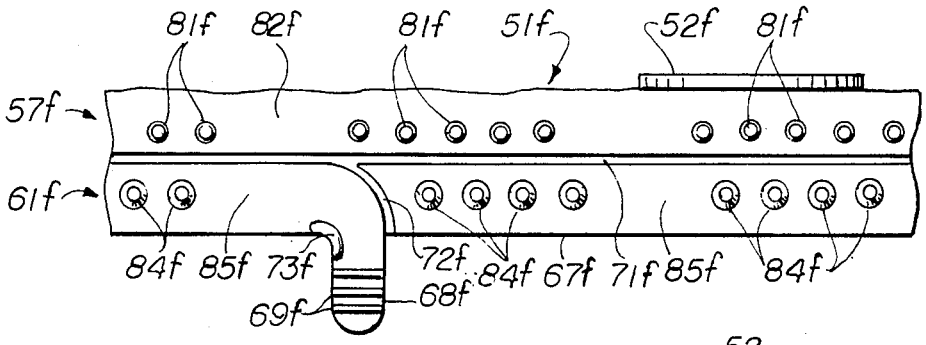

In FIG. 8, the cross-sections of the upper conical bead sections 81*e* are elliptical rather then circular, as are the cross-sections of the conical bead sections 84*e*. The pattern of the conical bead sections in FIG. 8 shows equal numbers and equal sizes of sections 81*d* and 84*d*. However, it will be understood, the distribution patterns of FIGS. 3, 4, 6 and 7 may be substituted therefor.

There is at least one upper bead section 81 vertically aligned with one of the bead sections 84 in each of the modifications shown in FIGS. 3, 4, and 6–8. In the modifications shown in FIGS. 9–13, the upper bead sections are aligned in the space between the lower bead sections. Thus, turning to FIG. 9, there are three groups of five bead sections 81*f* separated by gaps 82*f*. There are three groups of four lower bead sections 84*f* separated by gaps 85*f*. It will be noted that the spaces between the upper bead sections 81*f* are aligned with the lower bead sections 84*f*. This arrangement facilitates the capping operation and also facilitates stretching of the skirt during the capping operation. The shapes and sizes of the bead sections 81*f* and 84*f* resemble those in FIG. 3.

Figure 10:
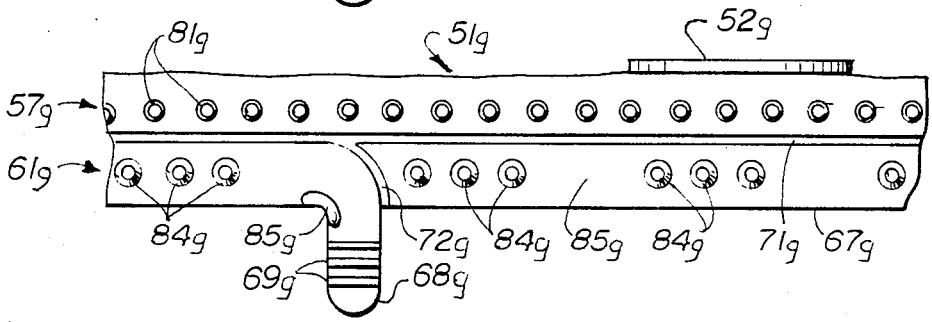

In FIG. 10 the bead sections 81*g* resemble in size and spacing the bead sections 81*a* of FIG. 4 and the bead sections 84*g* resemble the sections 84*a*. The pattern of distribution, however, is such that the bead sections 84*g* are aligned with the spaces between the upper bead sections 81*g*.

Figure 11:
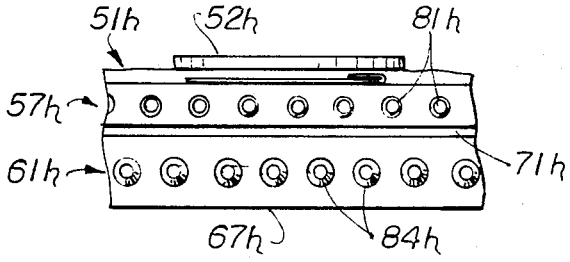

In FIG. 11, there are bead sections 81*h* equally spaced around the circumference of the inside of the skirt of the cap and likewise there are lower bead sections 84*h* similarly spaced around the perimeter of the cap skirt. The sections 84*h* are aligned in the spaces between the sections 81*h*.

Figure 12:
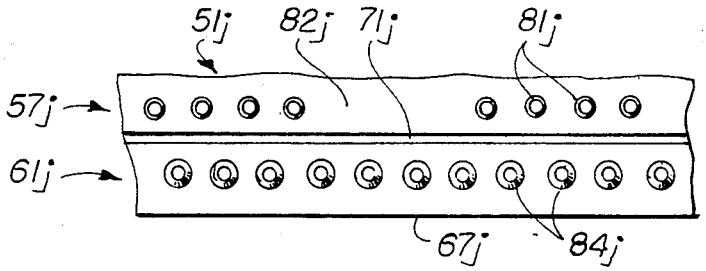

The distribution pattern in FIG. 12 resembles that of FIG. 7, except that the bead sections 81*j* are aligned in the spaces between the bead sections 84*j*.

Figure 13:
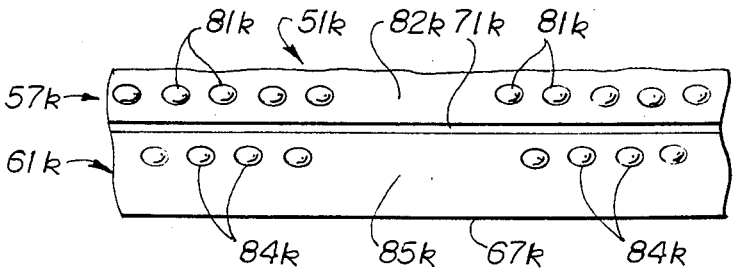

The distribution and shape of the bead sections 81*k* and 85*k* of FIG. 13 resemble the corresponding sizes and shapes of FIG. 8, except that the lower bead sections 84*k* are aligned with the spaces between the upper sections 81*k*. As was stated with respect to FIG. 8, the elliptical shapes shown in FIG. 13 may be substituted in any of the patterns of distribution shown in FIGS. 9–12.

Figure 5:
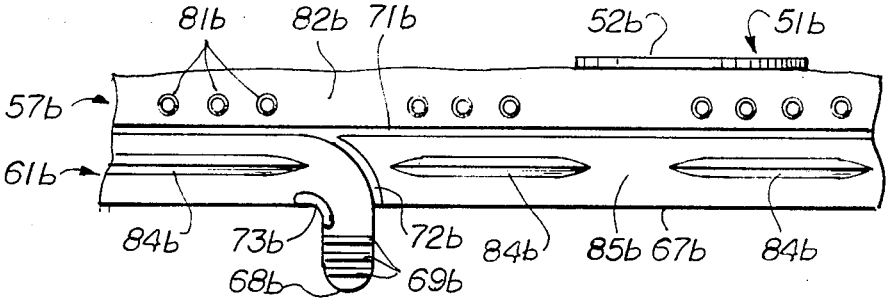

Turning now to FIG. 5, there are patterns of truncated conical upper bead sections 81*b* separated by gaps 82*b*. However, the lower bead sections 84*b* resemble the lower bead sections shown in U.S. Pat. No. 4,166,552. The pattern of distribution of the upper bead sections 81*b* is subject to variation from that shown in FIG. 5.

What is claimed is:

1. A plastic cap for sealing a container neck having a central axis, said cap comprising a top disc having a depending skirt concentric about said central axis, said skirt having first bead means extending around the inside of said skirt spaced downward from said disc, second bead means extending around the inside of said skirt spaced downward from said first bead means, scorelines in said skirt and tear means in juxtaposition to a portion of said scorelines, whereby by pulling said tear means and thereby tearing said skirt along said scorelines, the bottom of said skirt may be torn off, said first and second bead means being engageable with third and fourth bead means, respectively, on the exterior of said neck to inhibit removal of said cap without tearing off the portion of said skirt below said scorelines, said first bead means comprising discrete first bead sections each comprising a first having its axis along a radius substantially perpendicular to said central axis, said second bead means comprising discrete second bead sections each comprising a second cone having its axis along a radius substantially perpendicular to said central axis.

2. A cap according to claim 1 in which said first cones are truncated.

3. A cap according to claim 1 in which said second cones are truncated.

4. A cap according to claim 1 in which said first cones are circular in cross-section.

5. A cap according to claim 1 in which said second cones are elliptical in cross-section.

6. A cap according to claim 1 in which said scorelines comprise a first scoreline extending circumferentially around said skirt between said first and second bead means and a second scoreline extending up from the bottom of said skirt and merging with said first scoreline, said tear means being on the bottom edge of said skirt.

7. A cap according to claim 1 in which said first cones are grouped in groups separated by gaps.

8. A cap according to claim 7 in which said second cones are grouped in second groups separated by second gaps.

9. A cap according to claim 8 in which said first-mentioned and second gaps are aligned.

10. A cap according to claim 9 in which at least some of said second cones are aligned with first cones.

11. A cap according to claim 9 in which at least some of said second cones are aligned with spaces between said first cones.

12. A cap according to claim 8 in which said first and second-mentioned gaps are staggered.

13. A cap according to claim 12 in which at least some of said second cones are aligned with first cones.

14. A cap according to claim 12 in which at least some of said second cones are aligned with spaces between said first cones.

15. A cap according to claim 1 in which said second cones are grouped in groups separated by gaps.

16. A cap according to claim 15 in which at least some of said second cones are aligned with first cones.

17. A cap according to claim 15 in which at least some of said second cones are aligned with spaces between said first cones.

18. A cap according to claim 1 in which at least some of said first cones are aligned with second cones.

19. A cap according to claim 1 in which said first cones are aligned with spaces between said second cones.

20. A plastic cap for sealing a container neck and having a central axis, said cap comprising a top disc having a depending skirt concentric about said central axis, said skirt having first bead means extending around the inside of said skirt spaced downward from said disc, second bead means extending around the inside of said skirt spaced downward from said first bead means, scorelines in said skirt and tear means in juxtaposition to a portion of said scorelines, whereby by pulling said tear means and thereby tearing said skirt along said scoreline, the bottom of said skirt may be torn off, said first and second bead means being engageable with third and fourth bead means, respectively, on the exterior of said neck to inhibit removal of said cap without tearing off the portion of said skirt below said scorelines, one of said bead means comprising discrete first bead sections each comprising a first cone having its axis along a radius substantially perpendicular to said central axis, the other said bead means comprising discrete second bead sections each comprising a member elongated in a direction parallel to said top disc.

21. A cap according to claim 20 in which said second bead sections are located below the level of said first bead sections.

* * * * *